US006758213B1

(12) United States Patent
Brekken

(10) Patent No.: US 6,758,213 B1
(45) Date of Patent: Jul. 6, 2004

(54) DRINKING DEVICE FOR DIVERS

(76) Inventor: Rudolf Brekken, Knøsesmuget 8, N-5011 Bergen (NO)

( * ) Notice: Subject to any disclaimer, the term of this patent is extended or adjusted under 35 U.S.C. 154(b) by 0 days.

(21) Appl. No.: 09/743,582

(22) PCT Filed: Jun. 21, 1999

(86) PCT No.: PCT/NO99/00211

§ 371 (c)(1),
(2), (4) Date: Jan. 11, 2001

(87) PCT Pub. No.: WO00/02774

PCT Pub. Date: Jan. 20, 2000

(30) Foreign Application Priority Data

Jul. 13, 1998 (NO) ..... 19983208

(51) Int. Cl.[7] ..... A61M 15/00

(52) U.S. Cl. ..... 128/202.15; 128/201.26; 2/422

(58) Field of Search ..... 128/200.24, 201.18, 128/202.15, 205.25, 206.21, 206.27, 206.28, 201.22, 201.23, 201.26, 201.27, 201.28; 2/422; 222/175

(56) References Cited

U.S. PATENT DOCUMENTS

| | | | | | |
|---|---|---|---|---|---|
| 183,521 | A | * | 10/1876 | Weck | 128/202.15 |
| 1,366,437 | A | * | 1/1921 | Wagenhorst | 128/202.15 |
| 3,067,425 | A | * | 12/1962 | Colley | 128/202.15 |
| 3,645,261 | A | * | 2/1972 | West | 128/202.15 |
| 4,294,243 | A | * | 10/1981 | Ernesting et al. | 128/201.18 |
| 4,398,533 | A | * | 8/1983 | Barker | 128/202.15 |
| RE31,424 | E | * | 10/1983 | Ernesting et al. | 128/201.18 |
| 4,505,310 | A | * | 3/1985 | Schneider | 141/114 |
| 4,549,541 | A | * | 10/1985 | Sundahl | 128/201.19 |
| 4,712,594 | A | * | 12/1987 | Schneider | 141/114 |
| 4,813,083 | A | * | 3/1989 | Davidson | 2/422 |
| 4,815,893 | A | * | 3/1989 | Feder | 405/186 |
| 4,823,785 | A | * | 4/1989 | Mancosu et al. | 128/202.15 |
| 4,841,963 | A | * | 6/1989 | Vandeputte | 128/202.15 |
| 5,148,950 | A | * | 9/1992 | Hosaka | 222/175 |
| H1361 | H | * | 10/1994 | Tardiff, Jr. et al. | 128/206.12 |
| 5,389,024 | A | * | 2/1995 | Chen | 441/88 |
| 5,524,612 | A | * | 6/1996 | Chen | 128/202.15 |
| 5,634,780 | A | * | 6/1997 | Chen | 417/553 |
| 5,709,478 | A | * | 1/1998 | Chen | 383/80 |

OTHER PUBLICATIONS

Merriam Webster's Collegiate Dictionary 10th ed, 1997, pps. 669 & 1159.*

* cited by examiner

*Primary Examiner*—Henry Bennett
*Assistant Examiner*—Joseph F. Weiss, Jr.
(74) *Attorney, Agent, or Firm*—Francis C. Hand; Carella, Byrne, Bain et al.

(57) ABSTRACT

The drinking device for a diver can be mounted in a helmet or in a hollow-nasal mask mounted on the helmet. The drinking device includes a supply line which can be connected to a mouth piece within the helmet or mask to supply liquid under a slight pressure. In addition, a stopper arrangement is provided for regulating a flow of liquid through the supply line to the mouth piece. This stopper arrangement may be controlled manually by the diver.

13 Claims, 7 Drawing Sheets

DRINKING DEVICE FOR DIVERS

The present invention relates to a system for the supply of liquid to a diver who uses a diving helmet, from a container arranged externally relative to the helmet.

Systems for the supply of liquid on diving are not unknown. Several patent specifications show various solutions, but common to them all is that they are intended for divers who do not use diving helmets, that is to say in connection with sports diving and diving with air bottles. Normal depths in leisure diving (non-decompression diving) are up to about 40 m. The arrangements known from earlier solutions are adapted for "SCUBA" (leisure diving and sports diving equipment), and are therefore not designed for professional vocational diving, construction diving or diving "offshore" with deep diving equipment. Further, the known solutions only adapted for use together with sports diving equipment with diving masks and ordinary breathing valves (two-step with bite mouthpiece) which the diver can take by the grip of the hand to and from the mouth.

The object of the present invention is to provide a system which makes possible the intake of liquid on diving with a diving helmet, both for the type of helmet which vocational divers employ in connection with construction diving and the type of helmet which is used in the oil industry in connection with deep diving.

The loss of liquid in deep diving where warm water suits are employed has been found to be great, up to 4.5 litres during the course of a six hour dive. Such liquid loss can lead to dehydration which in turn is a health and safety problem. The supply of a sufficient quantity of liquid is therefore extremely important for health, safety and work productivity.

Deep diving for vocational divers is usually conducted at a depth of between 70–180 m., but it is not unusual to dive to depths of as much as 310 m. Equipment which today is used in connection with the intake of liquid is not designed for, or.applicable in connection with such diving.

U.S. Pat. No. 4,815,893 describes an underwater apparatus for leisure diving comprising a container for liquid, a hose connected to the holder for receiving liquid from the container, and a mouthpiece integrated with the hose.

U.S. Pat. No. 4,398,533 describes a drinking arrangement for divers which produces moisture in the mouth and lungs. The arrangement comprises a container having a chamber which holds the moisture, and a passage to the container. The diver sucks liquid past a valve, which thereafter must be closed.

U.S. Pat. No. 5,389,024 describes diving equipment comprising an air tank, a mouthpiece coupled to the air tank, a water container which is fastened to the air tank and which is connected to the mouthpiece, plus a pump and a battery arranged in the water container. The liquid is pumped to the mouthpiece.

EP 0 713 825 A1 describes a drinking arrangement which comprises a container having a cylinder which is arranged in a mouthpiece. The liquid is pumped to the mouthpiece by an electrical pump.

The system for the supply of liquid according to the present invention is characterised in that there is arranged in the diving helmet a guide-through arrangement comprising a housing portion which defines a space, where a part of the space stretches through a boring in the wall portion of the helmet so that there is established a communication duct between the inner side and outer side of the helmet, an inlet passage being arranged in the housing portion of the helmet, externally relative to the wall portion of the helmet, and an outlet passage internally relative to the wall portion of the helmet.

The invention will now be explained further with reference to the accompanying drawings, in which.

Figure 5C:
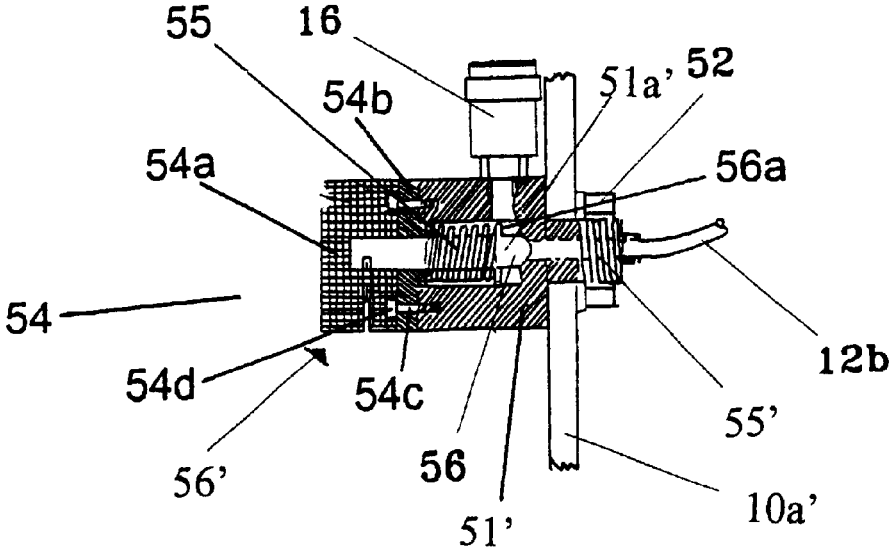
Figure 5A:
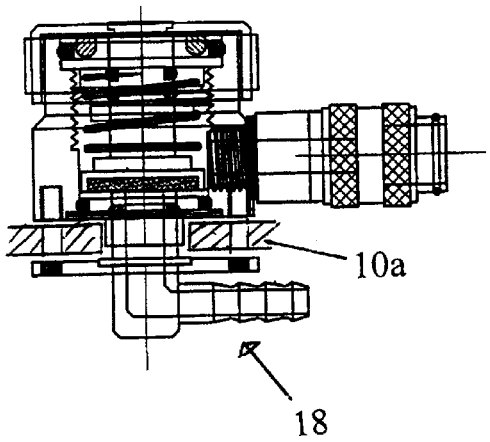

FIG. 5*a* shows a guide-through means according to the invention.

Figure 5B:
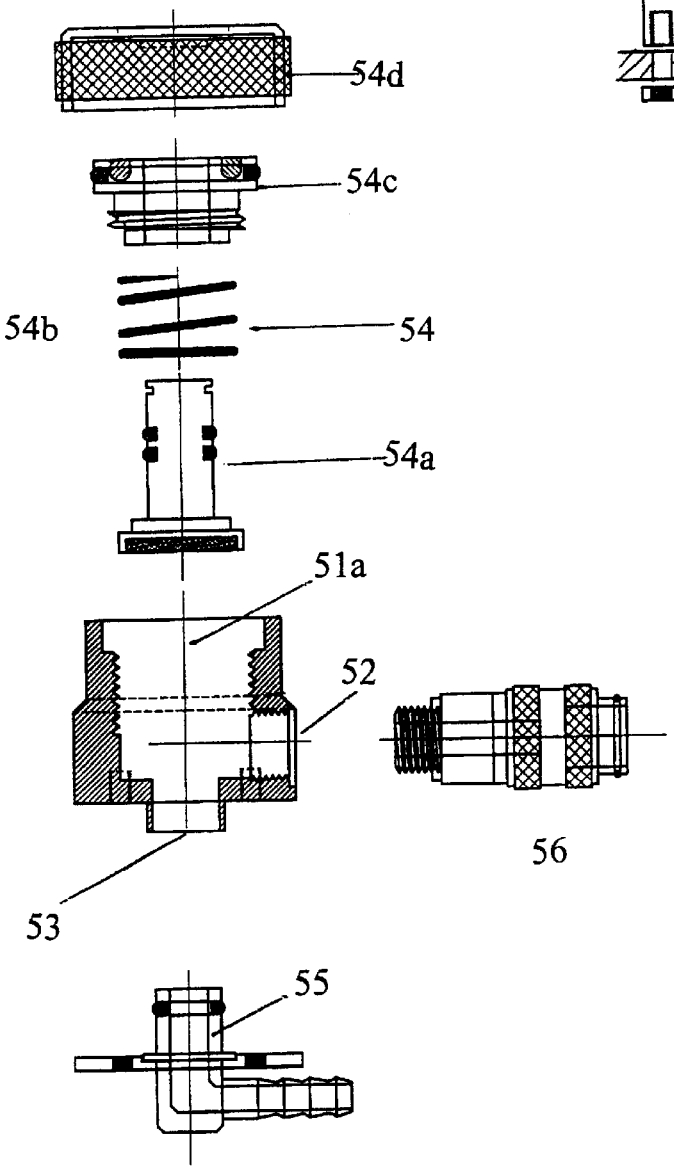

FIG. 5*b* shows the various components which constitute the guide-through means according to FIG. 5*a*.

FIG. 5*c* shows in section an alternative guide-through means arranged on the diving helmet according to the present invention.

Figure 6A:
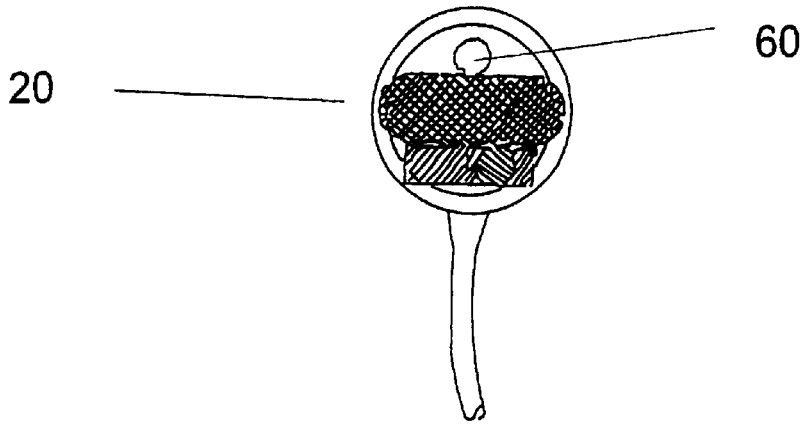
Figure 6B:
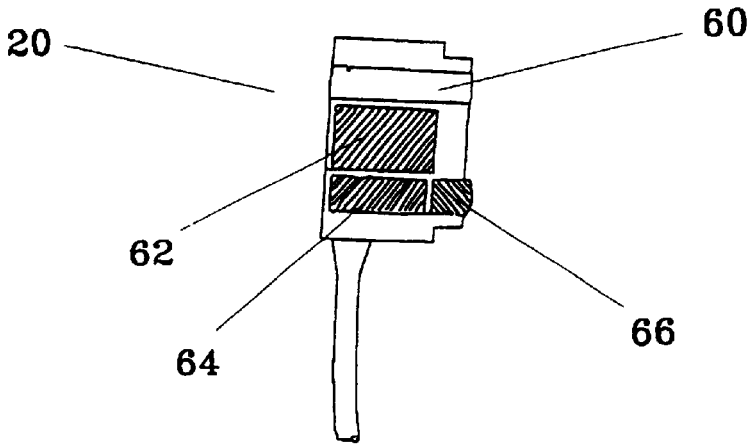

FIGS. 6*a* and 6*b* show in section a microphone insert according to the invention, seen respectively from the front and the side, in the oral-nasal mask, with passage for a liquid supply conduit.

Figures 6C, 6D:
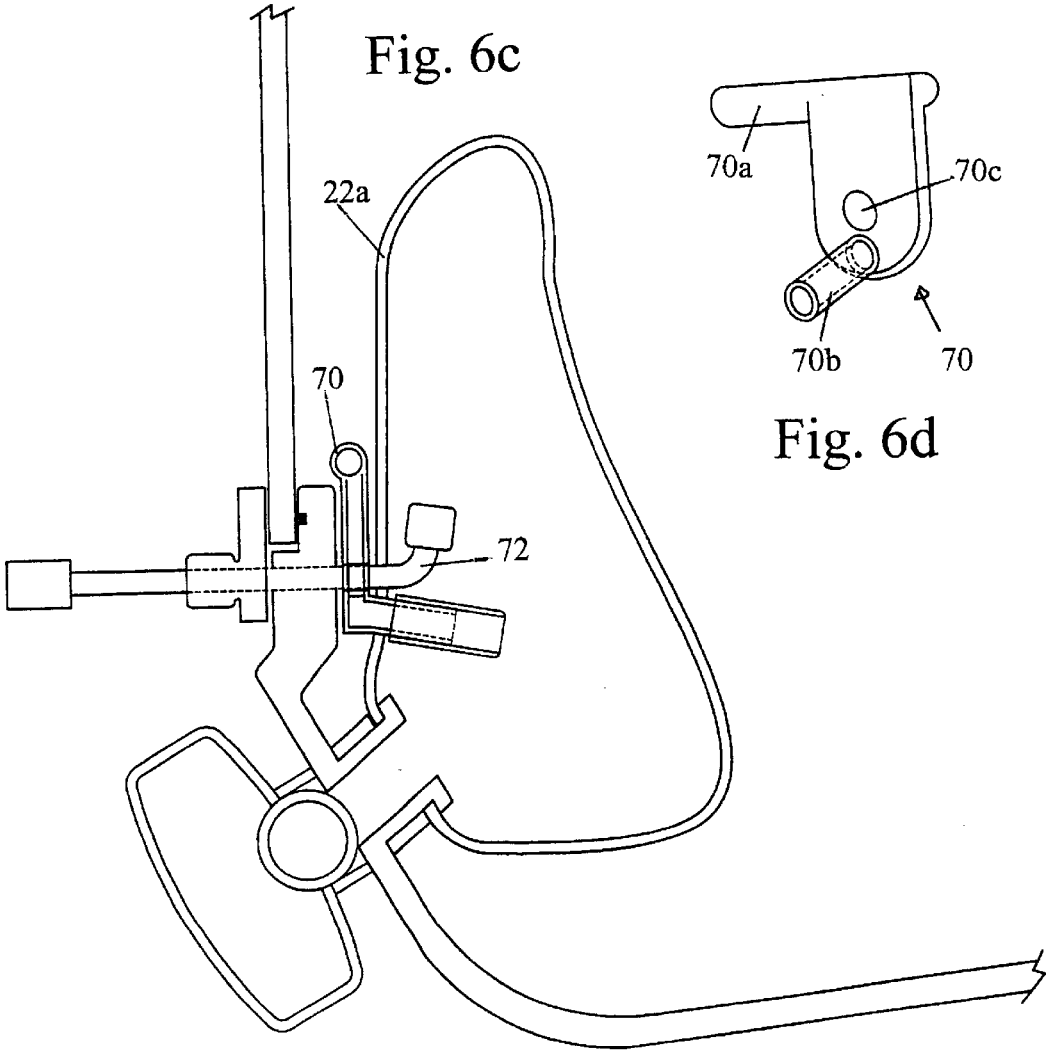

FIG. 6*c* shows an alternative embodiment of an arrangement for introducing liquid to the oral-nasal mask, and FIG. 6*d* shows in more detail the guide-through arrangement according to FIG. 6*c*.

Figure 1:
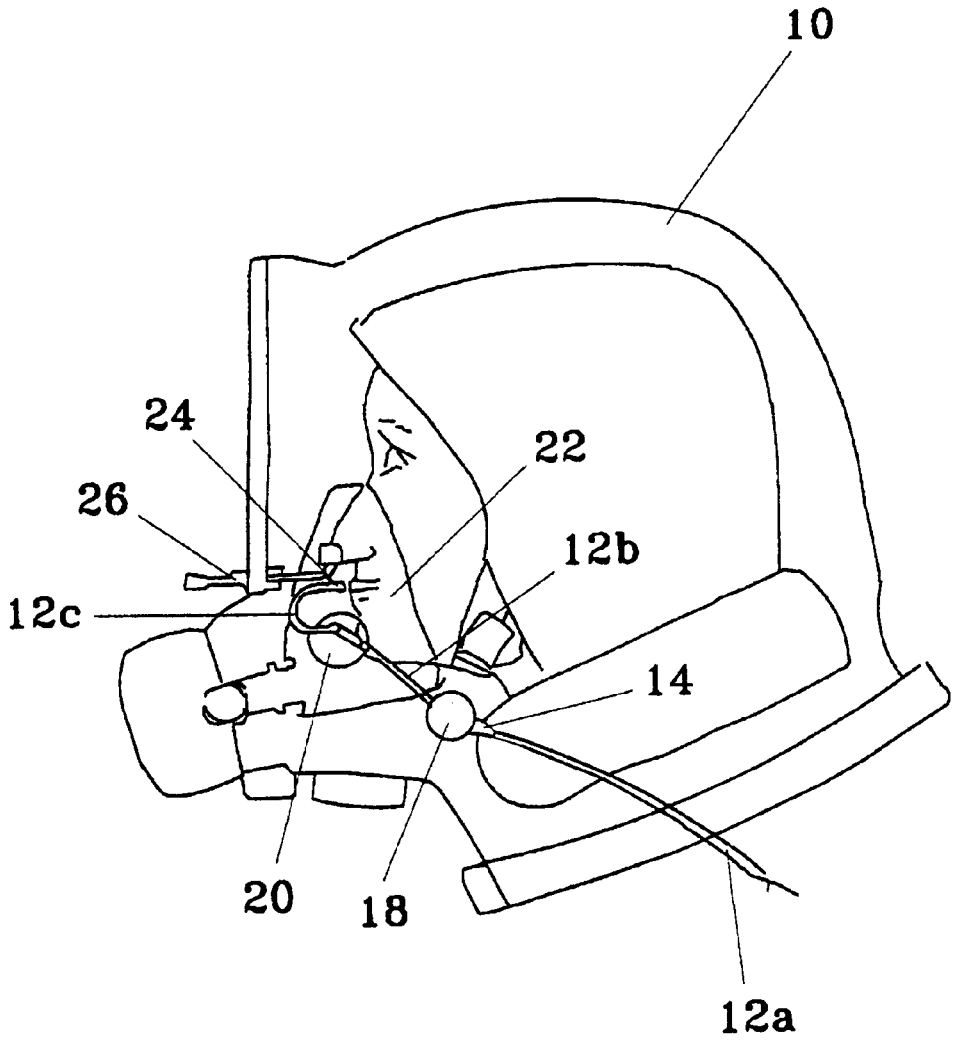
FIG. 1 shows a system according to the present invention for the supply of liquid in a diving helmet having an oral-nasal mask.

FIG. 1 shows the system for the supply of liquid in a diving helmet 10 having oral-nasal mask 22 according to the present invention. In a boring in the wall portion of the diving helmet 10 there is arranged a guide-through means 18. This guide-through means 18 terminates in its outer upper surface, and in that portion which is installed in the wall portion of the sealing helmet 10, sealingly against the wall portions which limit the boring so that water cannot penetrate into the helmet. There is also in the guide-through means 18 a boring so that liquid can be guided via the guide-through means 18 from the outer side of the helmet to the inner side of the helmet. The guide-through means 18 will be explained in more detail below.

In a supply pipe 12*a*, which for example can be a nylon pipe, there is arranged at its one end a male rapid coupling 14 which is coupled to a female rapid coupling 56 arranged on an outer side of the guide-through means 18. On the inner side of the guide-through means 18 is coupled a one end opening of a second supply pipe 12*b* to the guide-through means 18. With that the liquid can be guided via the pipes 12*a*, 12*b* and the guide-though means 18 and into the diving helmet 10.

In the embodiment which is shown in FIG. 1 an oral-nasal mask 22 is employed as mentioned, and the liquid must therefore also be led into this. In the form as shown in FIGS. 6*a* and 6*b* the supply pipe 12*b* is guided through a bore in the microphone insert 20 (further explained below), where said microphone 20 is fastened in the oral-nasal mask 22, and the other end opening of the supply pipe 12*b* is coupled to one end opening of a third supply pipe 12*c*. The other end of the supply pipe 12*c* is coupled to a drinking mouthpiece 24. The drinking mouthpiece 24 is fastened in the illustrated embodiment to the nose clip 26, so that the diver by movement of the nose clip 26 in a horizontal direction guides the drinking mouthpiece 24 to the mouth. An alternative embodiment for conducting liquid to the oral-nasal mask is shown in FIG. 6*c* and will be explained below.

Figure 2:
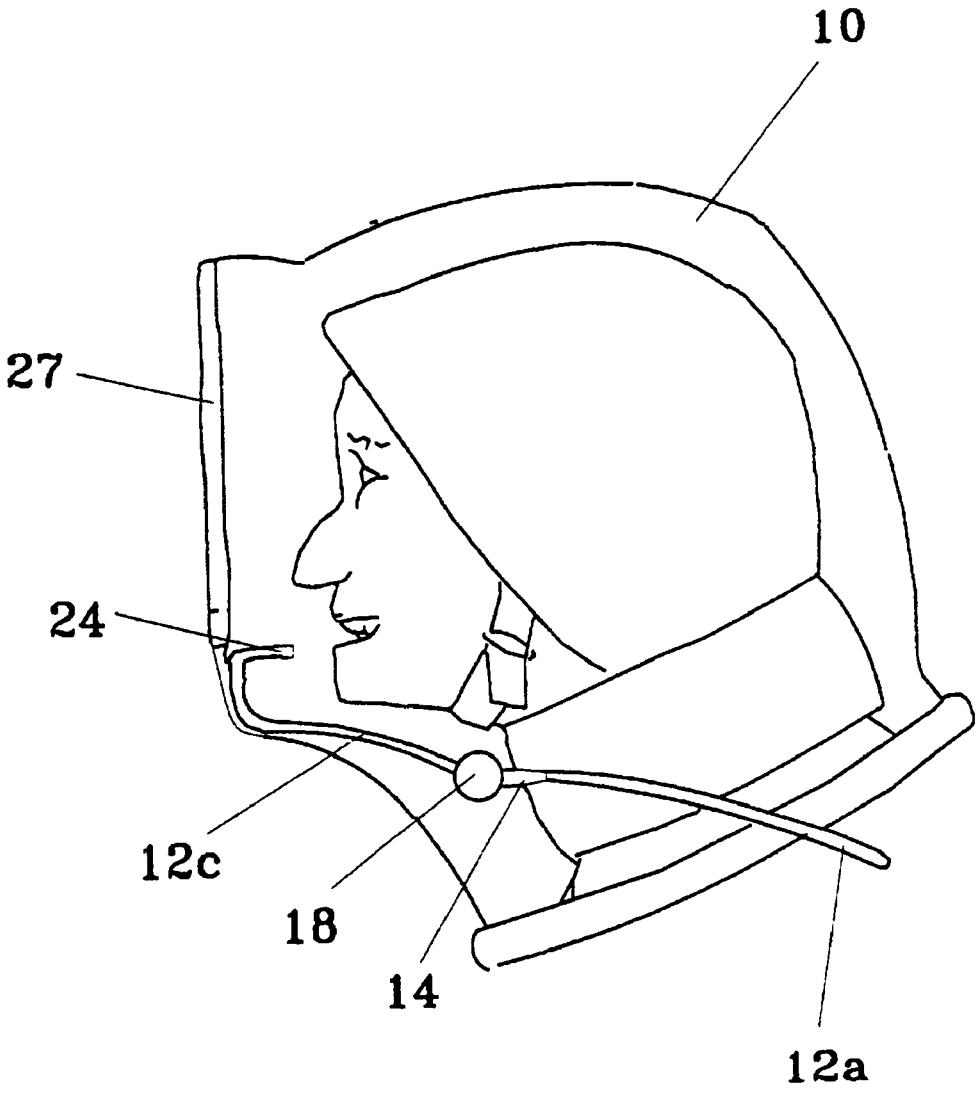
FIG. 2 shows a system according to the present invention for the supply of liquid in a diving helmet without an oral-nasal mask.

FIG. 2 shows a diving helmet correspondingly as shown in FIG. 1 but without the oral-nasal mask. Supply of liquid through the guide-through means 18 is as correspondingly described in FIG. 1. On the inner side of the guide-through means 18, that is to say within the diving helmet 10, one end opening of the supply pipe 12*c* is coupled, and the other end opening of the supply pipe 12*c* is coupled to the drinking mouthpiece 24. The drinking mouthpiece 24 is arranged in the under edge of the diving helmet glass 27, so that it is accessible to the mouth of the diver. The drinking mouthpiece 24 is fastened to the inside of the diving helmet by means of a resilient fastening means, if desired the drinking mouthpiece 24 can be constructed of a soft material.

Figure 3:
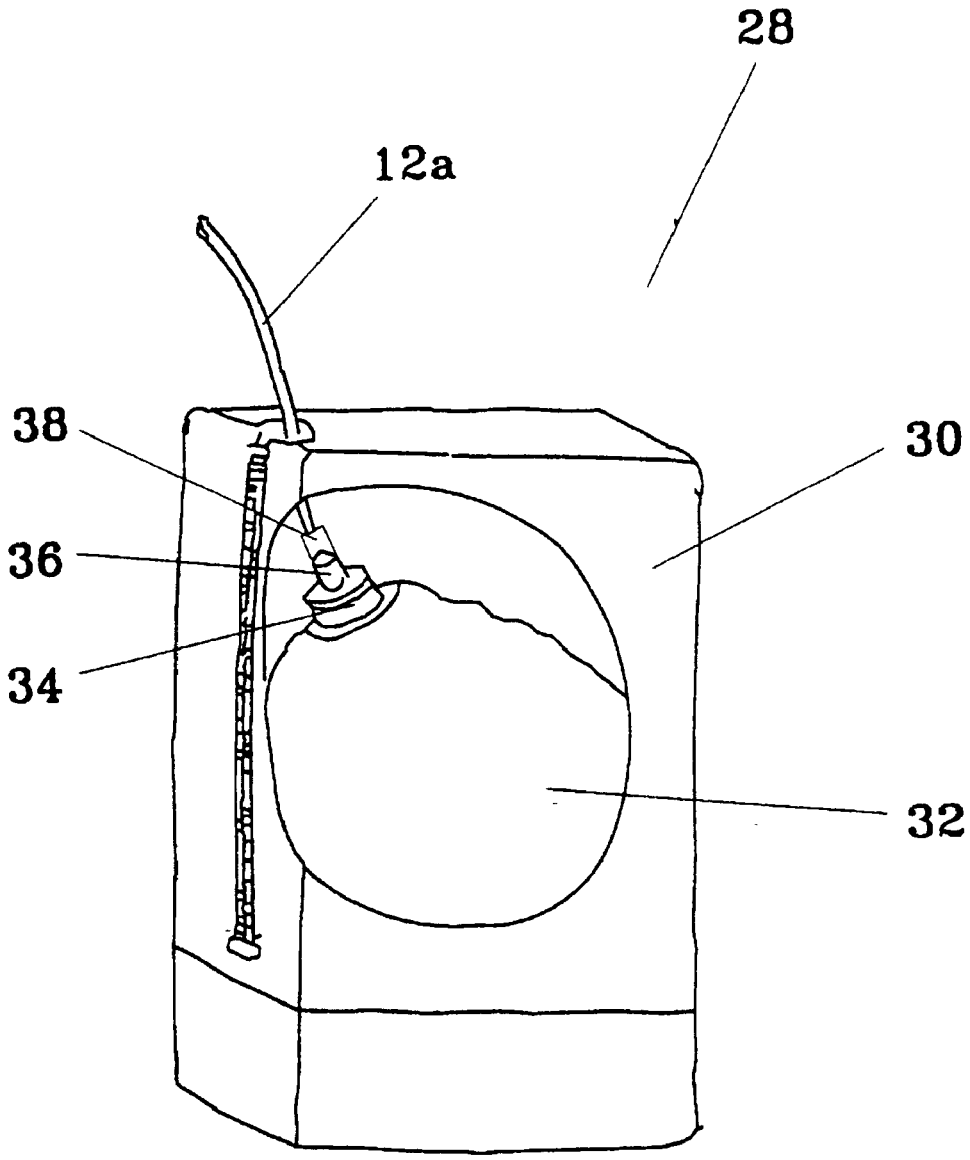
FIG. 3 shows an embodiment of a liquid container according to the present invention.

FIG. 3 shows an embodiment of a liquid container 28 according to the invention. The liquid container 28 comprises a storage unit 30, which is preferably arranged on the reserve gas flask of the diver, and which is made of a light semisoft material such as textile nylon. A liquid bag 32 filled with liquid is placed in the liquid container 30 and is held in place by a spring arrangement (not shown). The liquid bag 32 is preferably made of an elastic material such as plastic or rubber, and the spring arrangement will therefore produce a small excess pressure in the liquid bag 32. This excess pressure means that regardless of the depth the diver is situated there will be a constant relative hydrostatic excess pressure in the liquid bag 32. On one side surface of the liquid bag 32 an open/close mechanism is disposed comprising a female rapid coupling 36 which is closed when a male rapid coupling 38 is uncoupled. The male rapid coupling 38 is coupled to the supply pipe 12*a* which is led out through the storage unit 30 through an suitable opening and to the guide-through means 18.

Figure 4:
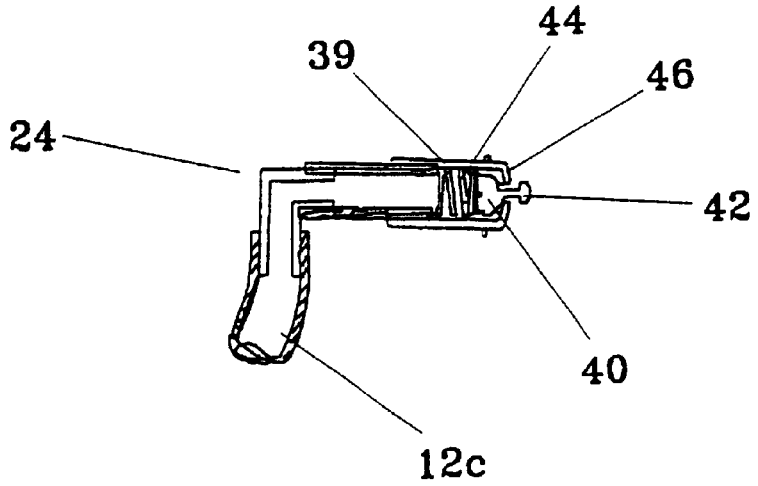
FIG. 4 shows a section of a drinking mouthpiece according to the invention.

FIG. 4 shows an embodiment of a drinking mouthpiece 24 according to the present invention coupled to the other end opening of the supply pipe 12*c*. The drinking mouthpiece 24 comprises an end unit 39 where there is arranged a sphere 40 having a T-shaped pin 42 and a spring 44. In a closed position, that is to say a non-drink position, the spring 44 presses against a portion of the surface 40 of the sphere whereby the opposite surface of the sphere, seen in a straight line through the centre of the circle, is pressed against hood 46 on the end unit 39 and closes to the supply of liquid. By pressing the sphere 40 by means of the T-pin 42 inwardly into the end piece 39 it is open for the supply of liquid, that is to say the drinking position. By virtue of the weak excess pressure which is established in the liquid bag 32, liquid will be supplied to the diver as the drinking mouthpiece 24 is brought to an open position by the mouth of the diver.

FIG. 5 shows a guide-through means 18 according to the invention. Centrally in the guide-through means 18 is a housing portion 50 which for example has a substantially cylindrical form, so that there is established a space 51*a* through which liquid can be led. The guide-through means 18 is arranged in the wall portion of the helmet 10 so that the space 51*a* communicates with both the inside and the outside of the helmet, that is to say so that liquid can be led via the guide-through means 18 from the outside to the inside of the helmet 10. In the housing portion there is thus arranged 1) an inlet passage 52 for the supply of liquid to the space 51*a*, and 2) an outlet passage 53 which leads the liquid out of the guide-through means 18. In a preferred embodiment (as shown in FIG. 5) there is also arranged 3) an opening 53 for the installation of a stopper arrangement 54 so as to regulate the speed of liquid flow through, possibly closing off the supply of liquid.

The guide-through means 18 is as mentioned arranged in the wall portion 10*a* of the helmet 10 as is evident from the collocation of FIG. 5*b*. An opening is bored in the wall portion 10*a* of the helmet 10. On each side of the helmet there are arranged securing means, 55*a* on the inner side of the helmet and 55*b* on the outer side of the helmet, respectively. In the housing portion 51 of the guiding-through means 18 there are arranged in the surface which faces towards the outer side of the helmet 10 for instance threaded borings for the reception of fastening means (not shown), so that the portions 35*a*, 55*b* can be fastened to the housing portion 51. The means 55*a*, 55*b* can for example be designed as disc gaskets, and if necessary provided with rubber surfaces in the portions which face towards wall portions 10*a* of the helmet 10. Thus there is guaranteed a wholly sealed guiding through. Liquid can thus be led from the space 51*a* and via the borings in the gasket means 55*a* and 55*b*, plus in the wall portion 10*a* of the helmet to the inside of the helmet via a coupling means 55 for instance provided with rapid coupling (not further shown) for coupling to the supply pipe 12*b*.

In the housing portion 51 the inlet portion 52 can be provided with internal threads so that a rapid coupling can be connected, for example as shown in FIGS. 5*a* and 5*b* where a female rapid coupling 56 is shown, so that liquid can be led via the supply pipe 12*a* to space 51*a* of the guide-through means 18.

The stopper arrangement 54 which is illustrated in FIG. 5*a* and 5*b* comprises a piston arrangement 54*a* which in a portion forms a liquid-tight seal between the arrangement 54*a* and the inner walls of the housing portion 51. The other components which are included in the stopper arrangement 54 are a spring 54*b* plus a fastening-in arrangement 54*c* (which for example is fixed to the housing portion 51) and a control wheel 54*d*. These components are fastened together with a screw. On lifting the control wheel 54*d* the liquid passage into the helmet is opened. The guide-through means 18 can be maintained in an open position by turning the control wheel 54*d* somewhat (as it is lifted out).

Another embodiment of the stopper arrangement is shown in FIG. 5*c* (where the arrangement is in a closed position) where an end piece 56' is maintained via a spring 55' with a constant pressure towards the cylindrical hollow space of the space 51*a'* so that the supply of liquid is closed off. The spring 55' is arranged at its one end against a groove 56*a'* on the end piece 56', and at its other end against a cover 54*b'*. To this cover 54*b'* a control wheel 54*a'* is arranged via screws 54*c'*. The control wheel 54*a'* is also fastened to the end piece 56', and when the control wheel 54*a'* is drawn somewhat out the end piece 56' will also follow, so that liquid will pass through the guiding-through means 18'. The spring 55' will be tightened as the control wheel 54*a'* is drawn out, the control wheel 54*a'* will then be guided back to the starting position (i.e. the valve is in a closed position) immediately the diver lets go of the control wheel 54*a'*.

The control wheel 54*a'* is provided with cavities 54*d'* which receive head portions of the screws 54*c'*. When the control wheel 54*a'* in a drawn out position is rotated with or against the watch hand, the control wheel 54*a'* will however bear against the head portions of the screws 54*c'*, and the control wheel will be held in such a drawn out position and the guide-through means 18' will be in an open position without it being necessary for the diver to hold the control wheel 54*a'*. With a simple hand grip, that is to say that the wheel 54*a* is rotated back, the wheel 54*a'*, by virtue of the elastic force in the tightened spring 55', will be guided back to the starting position, i.e. the end piece 56' will sealingly thrust against the inner cylindrical hollow space of the shaft 50, and the supply of liquid is closed off.

Alternatively, the stopper arrangement can be constructed as a ball valve (not shown) where a ball can be rotated from a first position where a duct through the ball connects the two pipe portions 12, 16 so that liquid is led through the valve, that is to say an open position, and to a second closed position where a ball surface is pressed against one of the pipe openings in order to close of f the supply of liquid. The stopper arrangement 54 can also be constructed with a piston as shown in FIG. 5*a* but where the flow of liquid can be regulated by screwing the piston inwards (reduced liquid supply) or outwards (increased liquid supply) relative to the housing portion. Alternatively the hose 12*a* can itself be equipped with a valve for opening and closing of the supply of liquid.

Regardless of which solution is chosen for the stopper arrangement 54, 54' it is important that the liquid supply can be simply closed off by the diver.

FIGS. 6*a* and 6*b* show a section of a microphone insert 20, seen respectively from the front and from the side, in the oral-nasal mask 22, having a through passage for a liquid supply pipe 12*c*. The microphone insert 20 comprises a through cylindrical hollow space 60, where the diameter of the hollow space is somewhat larger than the diameter of the supply pipe 12*c*, and a "mini electric microphone" 66, a amplifier unit 64 and a chargeable battery 62, or alternatively that the power supply to the microphone insert 20 is external via cable. The through cylindrical hollow space 60 is for example arranged between the battery 62, which is positioned about the central axis, and the arcuate outer edge of the microphone insert 20. The supply pipe can if desired be constructed so (not shown further) that it is possible to adjust the length of the pipe connection on the inside of the oral-nasal mask.

In a diver's helmet 10 having an oral-nasal mask 22, the diver has a limited freedom of movement, and the drink mouthpiece 24 must therefore be placed within the oral-nasal mask. It is therefore preferred that the microphone insert 20 is chosen as the point of insertion for the supply pipe 12*c*. In addition, the microphone insert 20 provides good support for the supply pipe. However, the invention is not limited to insertion through the microphone insert as other alternative places of insertion can also be employed, for example directly through a wall portion of the oral-nasal mask.

An alternative and for now preferred form of the insertion arrangement to the oral-nasal mask is shown in FIGS. 6*c* and 6*d*.

In FIG. 6*c*, a section is illustrated of how a guide-through arrangement 70 conducts liquid through wall portion ha of the oral-nasal mask. The guide-through arrangement 70 is mainly of flat design and hollow internally. In the arrangement there is an inlet device 70*a* and an outlet device 70*b*. These are arranged mainly at right angles to each other. Further there is arranged in the arrangement 70, a transverse opening 70*c*, and in this opening is arranged the bar 72 which goes to the nose clip. This ensures that the guide-through arrangement is held in place. On the intake there is coupled a supply hose 12*b*, and at the outlet there is optionally arranged a pipe connection 12*d* which functions as a mouthpiece for the diver. The opening which the nose clip goes through is then clearly sealed so that no liquid leaks out into the helmet.

It shall also be observed that the guide-through arrangement 70 can be led through other locations of the oral-nasal mask, for example via the flap valve.

In another preferred embodiment of a storage unit according to the present invention (not shown) a plate or another rigid material is arranged between the reserve gas bottle and the storage unit. On the opposite side of the storage unit a corresponding plate is arranged which is held in place by elastic straps which are fastened to the reserve gas flask. The two plates on opposite sides of the storage unit are pressed together because of the elastic straps and produce an excess pressure in the liquid bag.

According to another preferred form of the present invention the storage unit is placed in or at a diving bell or at the surface of the water, and the liquid is supplied to the diver together with remaining air- and gas-hoses. The storage unit in this embodiment can comprise a sealed tank where in the upper part of the tank there is arranged a close/open arrangement which makes possible filling of liquid. In the close/open arrangement a pressure relief valve is also arranged so as to prevent too high pressures in the liquid which is produced for the diver. A regulator supplies gas through a pipe coupling in the tank for producing excess pressure, which is ensured by the pressure relief valve. it is preferred that the excess pressure is between 0.01 and 0.1 bar above the surrounding pressure, more preferable 0.04 bar. In the under edge of the tank a hose coupling is arranged for the supply of liquid to the supply pipe 12*a*.

During a dive safety is the most important factor, leakage into the diving helmet must therefore be avoided. The system according to the present invention provides several solutions which prevent such undesired conveying of liquid to the diving helmet 10.

Firstly, liquid can be conducted through the drink mouthpiece 24 if the diver actively carries out an action, that is to say presses in the T-pin 42. If, however, the ball 40 in the drink mouthpiece 24 does not close fully in the closed position, because of for example rubbish and dirt, the diver can draw in the T-pin whereby the ball 40 is pressed towards the hood 46 on the end unit 39 and closes the supply of liquid.

The supply of liquid can further be closed off by adjusting the stopper arrangement 54. This arrangement is mounted externally of the diving helmet 10 and can be operated by the hand of the diver. The liquid supply can also be stopped by uncoupling of the male rapid coupling 14 from the female rapid coupling 56 on the guide-through means 18. The female rapid coupling 16, uncoupled from the male rapid coupling, closes so that liquid does not penetrate into the guide-through means 18.

According to the present. invention a system is thus provided for the supply of liquid from an external container to a diver who uses a diving helmet.

Obviously the invention is not to be considered as limited to the embodiments described and illustrated, but it can be modified in a great many possibilities within the scope of the protection which is claimed.

What is claimed is:

1. A combination comprising a diving helmet for encompassing a head of a diver;

a guide-through means fixedly mounted on said helmet to define a communication duct between an inside of said helmet and an outside of said helmet, said guide-through means including a housing portion defining a passage therethrough, a piston slidably mounted in said housing portion between a first position closing said passage and a second position opening said passage to a flow of fluid, a spring biasing said piston toward said first position, and a control wheel rotatable mounted on said housing portion to selectively compress said spring towards said piston to regulate the biasing force of said spring on said piston and thereby to regulate the amount of flow through said passage;

a supply line connected to said passage of said means to supply liquid thereto; and a mouthpiece within said helmet and in communication with an opposite side of said passage from said supply line to receive a flow of liquid therefrom; and an end unit in said mouthpiece to selectively open said mouthpiece for dispensing a flow of liquid therefrom.

2. The combination as set forth in claim 1 wherein said end unit in said mouthpiece includes a spring biased sphere within said mouthpiece for selectively closing said mouthpiece to a passage of liquid therefrom and a pin projecting from said sphere and out of said mouthpiece.

3. The combination as set forth in claim 1 which further comprises a container for storing liquid remote from said helmet and in communication with said supply line to deliver liquid thereto.

4. The combination as set forth in claim 3 wherein said container is made of elastic material to receive liquid under a hydrostatic pressure for delivering liquid into said supply line under pressure.

5. The combination as set forth in claim 1 which further comprises an oral-nasal mask mounted on and within said helmet and having said guide-through means mounted therein.

6. The combination as set forth in claim 5 wherein said mask has a bore for receiving a microphone and which further comprises a second supply line connected between said passage of said guide-through means and said mouthpiece and passing through said bore.

7. The combination as set forth in claim 5 wherein said mask has a nose clip, a bar extending from said nose clip and said guide-through means is of flat hollow construction and is mounted on said bar.

8. The combination as set forth in claim 5 wherein mouthpiece is movably mounted in said mask and projects through said helmet for manual movement thereof.

9. A combination comprising a diving helmet for mounting about the head of a diver;

a guide-through means mounted on said helmet to define a communication duct between an inside of said helmet and an outside of said helmet, said guide-through means including a housing portion defining a passage therethrough, a piston slidably mounted in said housing portion between a first position closing said passage and a second position opening said passage to a flow of fluid, a spring biasing said piston toward said first position, and a control wheel rotatably mounted on said housing portion outside said helmet to selectively compress said spring towards said piston to regulate the biasing force of said spring on said piston;

a supply line connected to said means to supply liquid thereto;

a mouthpiece within said helmet and in communication with said supply line to receive a flow of liquid therefrom;

a spring biased sphere mounted in said mouthpiece for movement between an extended position closing said mouthpiece to the exhaust of liquid therefrom and a retracted position allowing a flow of fluid therefrom; and a pin extending from said sphere for manipulation by a diver for moving said sphere against said spring to allow a flow of fluid from said mouthpiece.

10. The combination as set forth in claim 9 further comprising an oral-nasal mask mounted within said helmet and having said mouthpiece mounted thereon.

11. A combination comprising a diving helmet for mounting about the head of a diver;

a guide-through means fixedly mounted on said helmet to define a communication duct between an inside of said helmet and an outside of said helmet, said guide-through means including a housing portion defining a passage therethrough, means for selectively opening and closing said passage to a flow of liquid therethrough, a first spigot extending from said housing outside said helmet and communicating with said passage and a second spigot extending from said housing within said helmet and communicating with said passage;

a supply line connected to said first spigot to supply liquid thereto;

a second line within said helmet and connected to said second spigot to receive a flow of liquid therefrom;

a mouthpiece within said helmet and in communication with said second line to receive a flow of liquid therefrom; and an end unit in said mouthpiece to selectively open said mouthpiece for dispensing a flow of liquid therefrom.

12. The combination as set forth in claim 11 wherein said end unit in said mouthpiece includes a spring biased sphere mounted in said mouthpiece for movement between an extended position closing said mouthpiece to the exhaust of liquid therefrom and a retracted position allowing a-flow of fluid therefrom; and a pin extending from said sphere for manipulation by a diver for moving said sphere against said spring to allow a flow of fluid from said mouthpiece.

13. The combination as set forth in claim 11 further comprising an oral-nasal mask mounted within said helmet and having said mouthpiece mounted thereon.

* * * * *